US008419085B2

(12) United States Patent
Kim et al.

(10) Patent No.: US 8,419,085 B2
(45) Date of Patent: Apr. 16, 2013

(54) CASE LOCKING DEVICE

(75) Inventors: Kyoungsu Kim, Anyang-si (KR); Hakryun Kang, Gwangju-si (KR)

(73) Assignee: Humax Co., Ltd., Seongnam-Si, Kyouonggi-Do (KR)

( * ) Notice: Subject to any disclaimer, the term of this patent is extended or adjusted under 35 U.S.C. 154(b) by 569 days.

(21) Appl. No.: 12/265,022

(22) Filed: Nov. 5, 2008

(65) Prior Publication Data

US 2010/0001538 A1 Jan. 7, 2010

(30) Foreign Application Priority Data

Jul. 7, 2008 (KR) ..... 10-2008-0065420

(51) Int. Cl.

| | |
|---|---|
| ***E05C 1/08*** | (2006.01) |
| ***E05C 1/12*** | (2006.01) |
| ***E05C 1/10*** | (2006.01) |
| ***E05C 1/02*** | (2006.01) |

(52) U.S. Cl.

USPC ..... 292/163; 292/164; 292/174; 292/175; 292/137

(58) Field of Classification Search ..... 292/163, 292/137, DIG. 11, 164, 174, 175, DIG. 61

See application file for complete search history.

(56) References Cited

U.S. PATENT DOCUMENTS

| | | | | | |
|---|---|---|---|---|---|
| 1,370,942 | A | * | 3/1921 | Binkley | 70/70 |
| 1,935,626 | A | * | 11/1933 | Evans | 292/86 |
| 3,391,553 | A | * | 7/1968 | Norrenberg-Sudhaus | 70/70 |
| 3,646,787 | A | * | 3/1972 | Norrenberg-Sudhaus | 70/70 |
| 4,390,198 | A | * | 6/1983 | Selinko | 292/152 |
| 5,722,705 | A | * | 3/1998 | Deguchi | 292/87 |
| 5,823,644 | A | * | 10/1998 | Suh et al. | 312/223.2 |
| 5,848,719 | A | * | 12/1998 | Goldenberg | 220/326 |
| 5,933,321 | A | * | 8/1999 | Ruch et al. | 361/679.42 |
| 6,129,430 | A | * | 10/2000 | Wu | 312/223.2 |
| 6,347,872 | B1 | * | 2/2002 | Brechbill et al. | 359/879 |
| 6,428,057 | B1 | * | 8/2002 | Reise | 292/32 |
| RE37,916 | E | * | 12/2002 | Szapucki et al. | 292/175 |

(Continued)

FOREIGN PATENT DOCUMENTS

| | | |
|---|---|---|
| KR | 20-1998-013920 | 10/1998 |
| KR | 20-1998-0012015 | 2/2000 |

(Continued)

OTHER PUBLICATIONS

Korean Office Action dated Dec. 9, 2009 for Application No. 10-2008-0065420.

(Continued)

*Primary Examiner* — Thomas Beach
*Assistant Examiner* — Nathan Cumar
(74) *Attorney, Agent, or Firm* — KED & Associates LLP

(57) ABSTRACT

A case locking device is provided. For example, an outer case and an inner case used for various types of electronic devices, such as set-top boxes (STB), are connected by a lock using a resilient force from an elastic material, such as a spring, so that the outer case and the inner case may be separated from each other using only a separately provided jig. Accordingly, the outer case and the inner case may be connected to each other more easily and any general user may be prevented from separating the case arbitrarily, thus making it possible to effectively prevent catastrophic failures from occurring at the electronic device due to a user's arbitrary manipulation.

20 Claims, 7 Drawing Sheets

U.S. PATENT DOCUMENTS

| | | | | |
|---|---|---|---|---|
| 6,588,809 | B1 * | 7/2003 | Derman | 292/129 |
| 6,722,712 | B2 * | 4/2004 | Schultz | 292/175 |
| 6,762,928 | B2 * | 7/2004 | Lo | 361/679.58 |
| 6,948,278 | B1 * | 9/2005 | Schultz | 49/185 |
| 7,050,295 | B2 * | 5/2006 | Kang | 361/679.58 |
| 7,165,790 | B2 * | 1/2007 | Bella et al. | 292/34 |
| 7,410,194 | B2 * | 8/2008 | Chen et al. | 292/37 |
| 2001/0011620 | A1 * | 8/2001 | Tiramani et al. | 190/124 |
| 2007/0120376 | A1 * | 5/2007 | Bella | 292/163 |
| 2008/0100068 | A1 * | 5/2008 | Kim | 292/163 |

FOREIGN PATENT DOCUMENTS

| | | | |
|---|---|---|---|
| KR | 20-0005513 | | 10/2000 |
| KR | 10 2006 0080005 | * | 7/2006 |
| KR | 10-2006-0080005 | * | 7/2006 |
| KR | 10-2006-0080005 A | | 7/2006 |

OTHER PUBLICATIONS

Korean Notice of Allowance dated Apr. 9, 2010.

* cited by examiner

CASE LOCKING DEVICE

This application claims the benefit of Korean Patent Application No. 10-2008-0065420 filed on Jul. 7, 2008, which is hereby incorporated by reference.

BACKGROUND

1. Field

The present invention relates to a case locking device, and more specifically to a case locking device that enables locking to be more easily done between an outer case and an inner case that are used for various types of electronic devices, for example, such as set-top boxes and the like, and prevents a general user from separating between the two cases arbitrarily.

2. Description of the Related Art

In general, various types of electronic devices, such as set-top boxes receiving digital broadcast, are manufactured and sold in the form of a box that has an outer case and an inner case locked to the outer case. The outer case and the inner case are firmly locked, for example, by screws or other connecting elements such as bolts and nuts.

In the meanwhile, a general user may easily separate the outer case and the inner case from each other by using a flat-head screw driver or Phillips screw driver that may be easily obtained at home when the outer case and the inner case are locked to each other through screws or other connecting elements such as bolts and nuts.

For instance, the general user may arbitrarily release the screws that join the outer case to the inner case by using a flat-head screw driver or Phillips screw driver when an electronic device such as a set-top box does not operate normally.

Accordingly, the number of catastrophic failures gradually increases due to user's arbitrary manipulations. However, there are not yet prepared any solutions of being capable of effectively preventing such failures in advance.

SUMMARY

The present invention is made in consideration of the above problem, and an aspect of the present invention provides a case locking device that does not only enable locking to be more easily done between an outer case and an inner case that are used, for example, for various types of electronic devices such as set-top boxes and the like, but also prevents a general user from arbitrarily separating the outer case and the inner case from each other by using a common flat-head screw driver or Phillips screw driver.

BRIEF DESCRIPTION OF THE DRAWINGS

The accompany drawings, which are included to provide a further understanding of the invention and are incorporated on and constitute a part of this specification illustrate embodiments of the invention and together with the description serve to explain the principles of the invention.

DETAILED DESCRIPTION OF PREFERRED EMBODIMENTS

Reference will now be made in detail embodiments of the invention examples of which are illustrated in the accompanying drawings.

Hereinafter, a case locking device according to an exemplary embodiment of the present invention will be described in detail with reference to accompanying drawings.

To begin with, the case locking device may apply to various types of electronic devices that are manufactured in the form of a box where an outer case and an inner case are connected to each other. For example, the outer case and the inner case of an electronic device such as a set-top box ("STB") to which the present invention applies are connected to each other by a connecting means using a resilient force exerted from an elastic material such as a spring.

Figure 1:
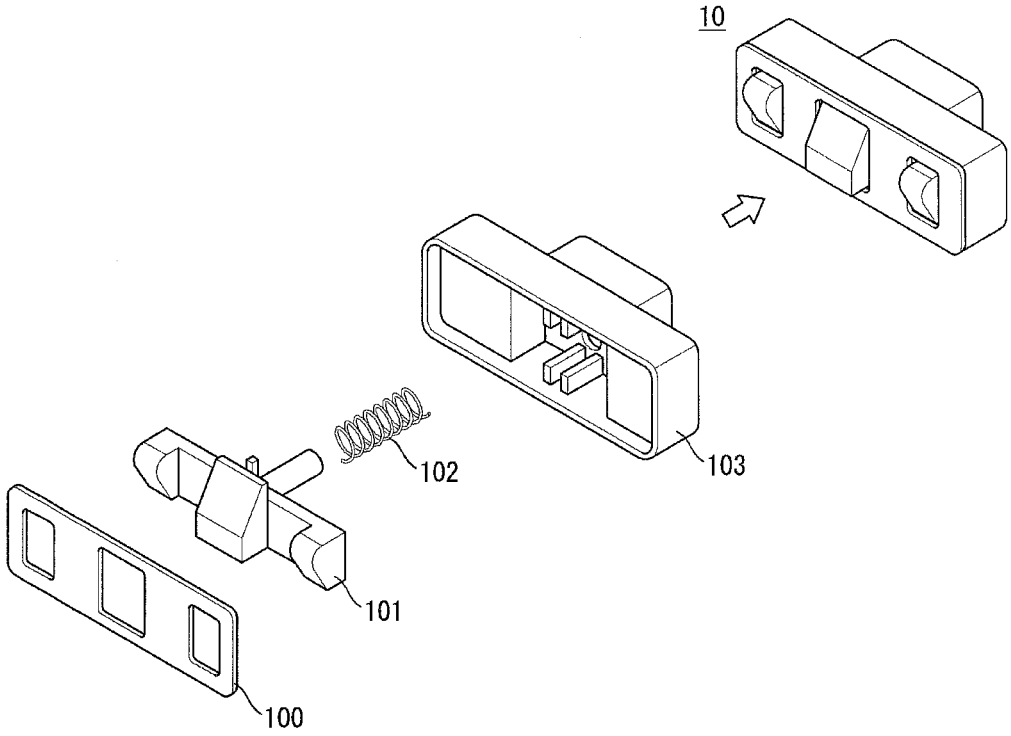
FIG. 1 is a view illustrating a locking unit applying to a case locking device according to an exemplary embodiment of the present invention.

For instance, the locking unit 10 used as a connecting means according to the present invention is configured as an assembly that comprises a cover front 100, a hook 101, a spring 102, and a cover rear 103, as shown in FIG. 1.

In the meanwhile, the hook 101 comprises a protrusion having an inclined angle in the positive direction at its center, and two protrusions having an inclined angle in the negative direction at its both sides.

Figure 2:
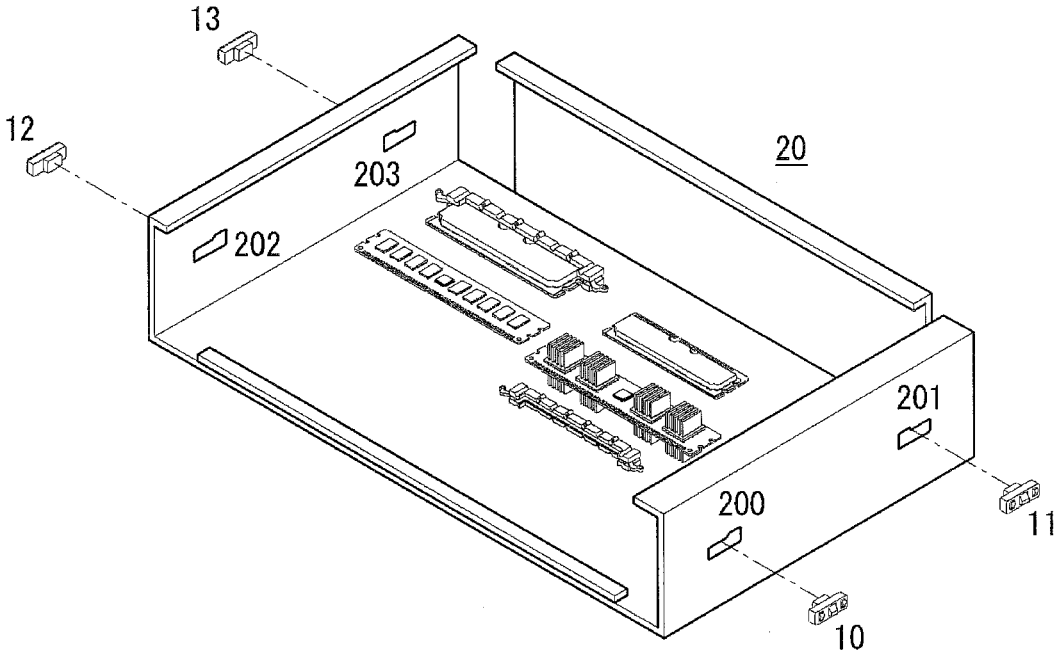
FIG. 2 is a view illustrating an inner case applying to a case locking device according to an exemplary embodiment of the present invention.

In addition, the locking unit 10 is inserted into an insert hole that is formed at both sides of the inner case. For example, the inner case 20 has four insert holes 200 to 203 at its both sides to insert four locking units 10 to 13 as shown in FIG. 2.

And, each insert hole comprises a through hole with a narrow area and a through hole with a broad area that are integrally formed. Accordingly, the locking unit 10 is firstly inserted through the through hole with the broad area and then transferred in left or right direction toward the through hole with the narrow area. By doing so, the locking unit 10 may be firmly inserted in the through hole with the narrow area.

Figure 3:
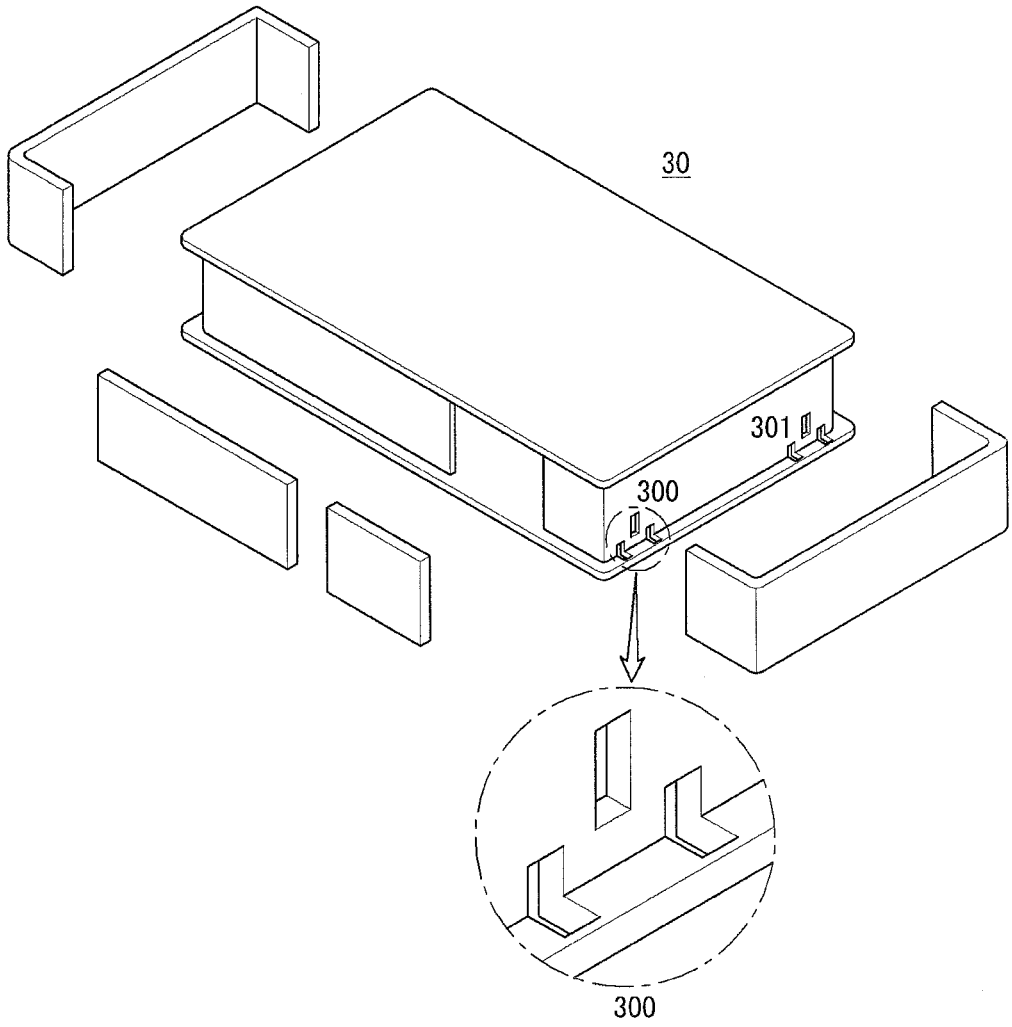
FIG. 3 is a view illustrating an outer case applying to a case locking device according to an exemplary embodiment of the present invention.

In the meanwhile, four fasteners 300 to 303 are provided at both sides of the outer case 30 to connect to the four locking units 10 to 13 as shown in FIG. 3. Each fastener comprises one hole that penetrates a side surface of the outer case and two holes that penetrate the side surface and the bottom surface of the outer case and has the shape of the letter "L".

Figure 4:
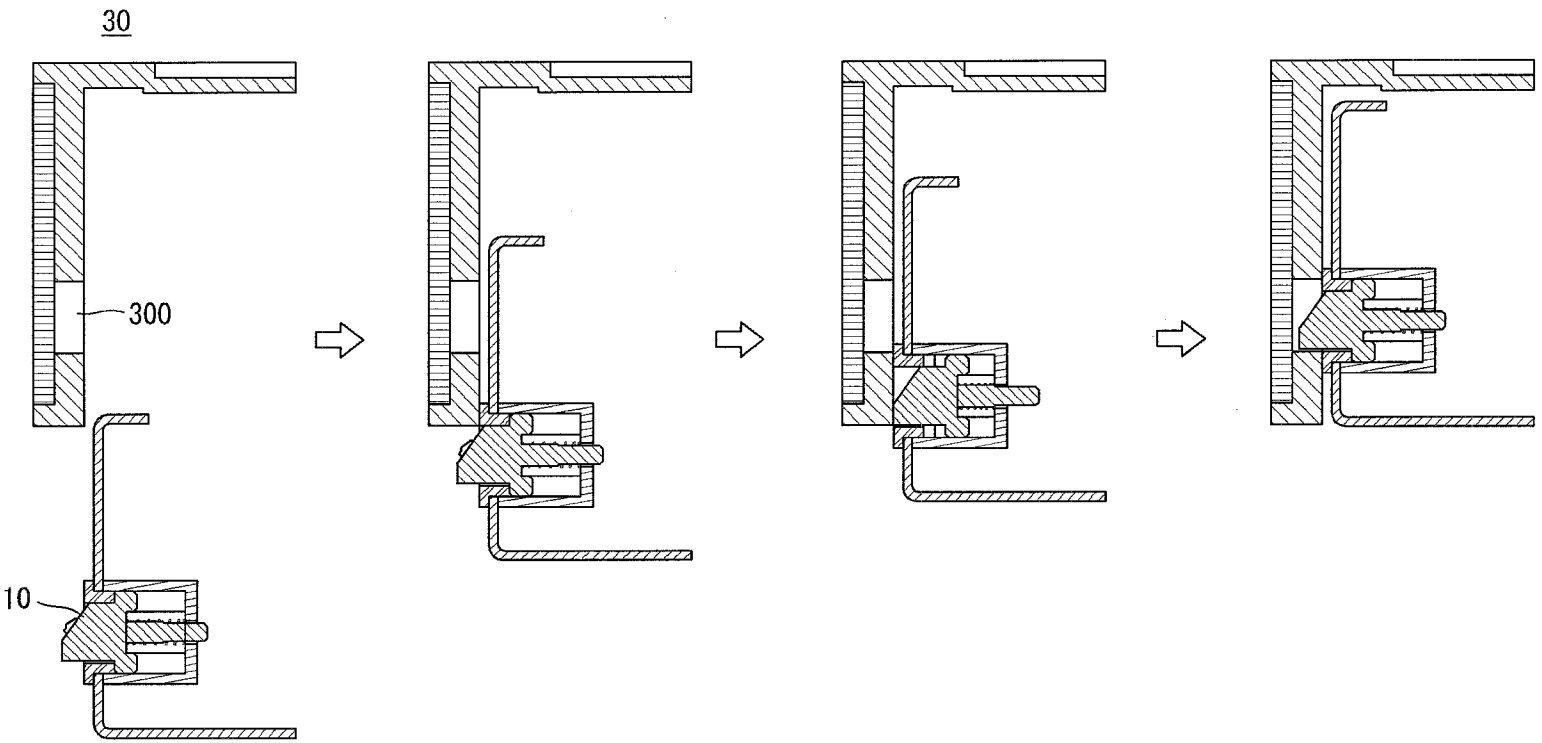
FIG. 4 is a view illustrating processes where an outer case and an inner case are connected to each other according to an exemplary embodiment of the present invention.

For example, the protrusion formed in the middle of the locking unit 10 gradually moves toward the inside of the inner case when the outer case 30 having the fastener 300 is gradually brought down in the vertical direction, with the locking unit 10 inserted in the insertion hole of the inner case 20, as shown in FIG. 4.

Thereafter, the protrusion of the locking unit returns to the original location by a resilient force exerted from the spring comprised in the locking unit 300, and therefore, the protrusion of the locking unit is inserted into the fastener 300 of the outer case. Consequently, the inner case may be easily connected to the outer case.

Figure 5:
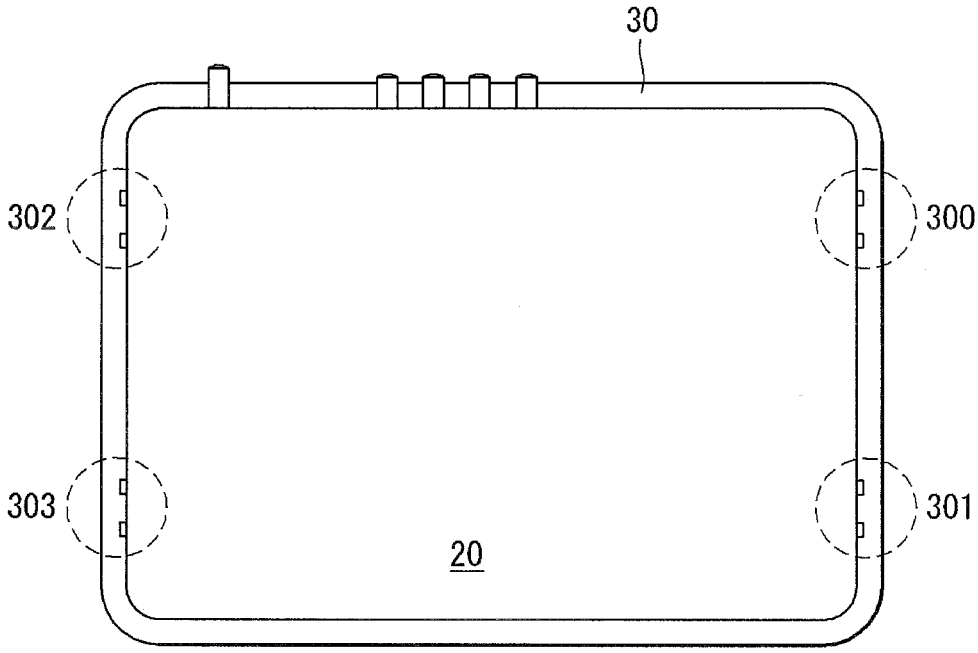
FIG. 5 is a rear view illustrating a state where an outer case and an inner case are connected to each other according to an exemplary embodiment of the present invention.

Eight small holes are exposed in four pairs from both sides of the bottom end of the outer case 30, with the outer case and the inner case connected to each other through the above processes, as shown in FIG. 5 which is a rear view of the electronic device.

Figure 6:
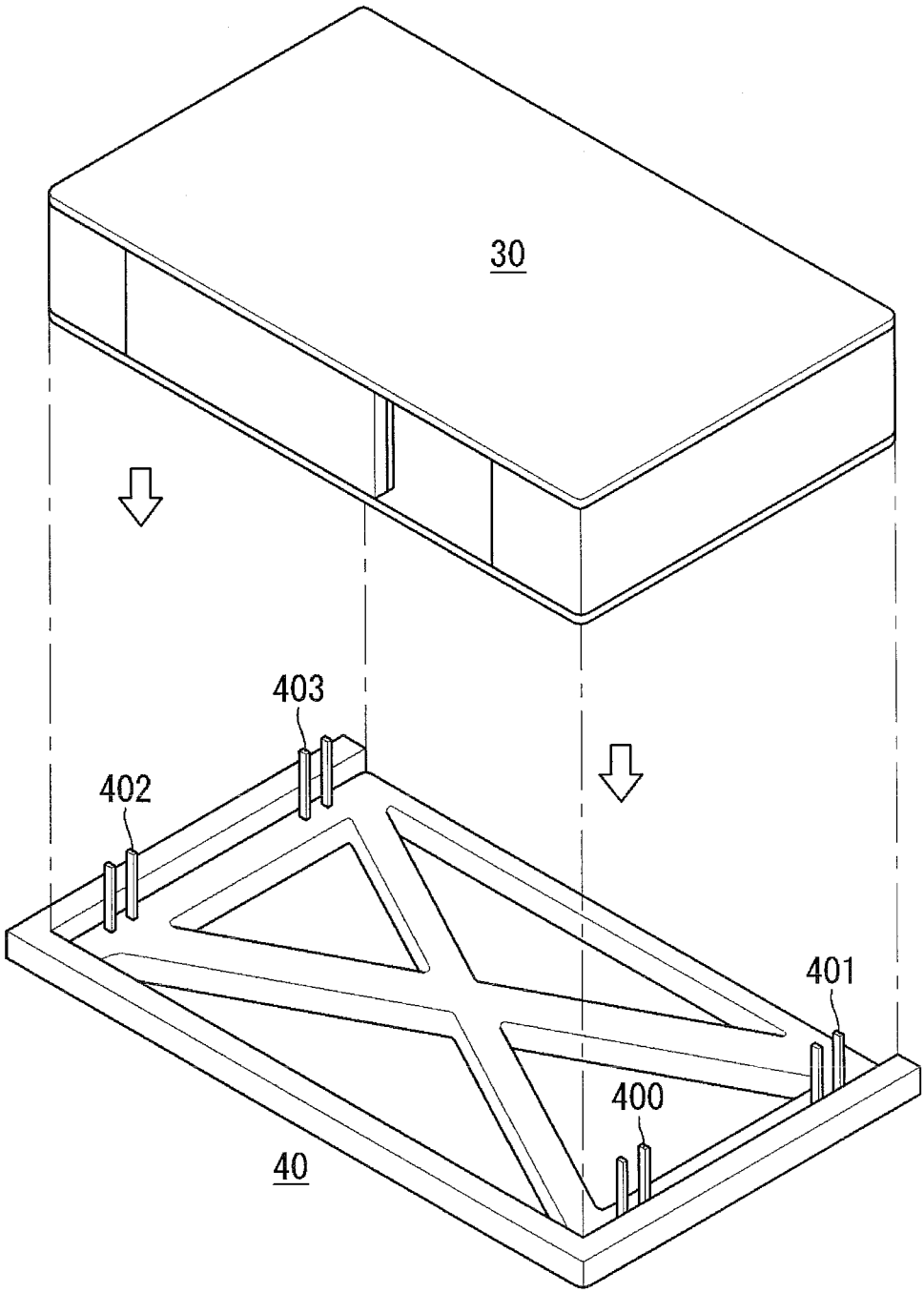
FIG. 6 is a view illustrating a jig according to an exemplary embodiment of the present invention.
Figure 7:
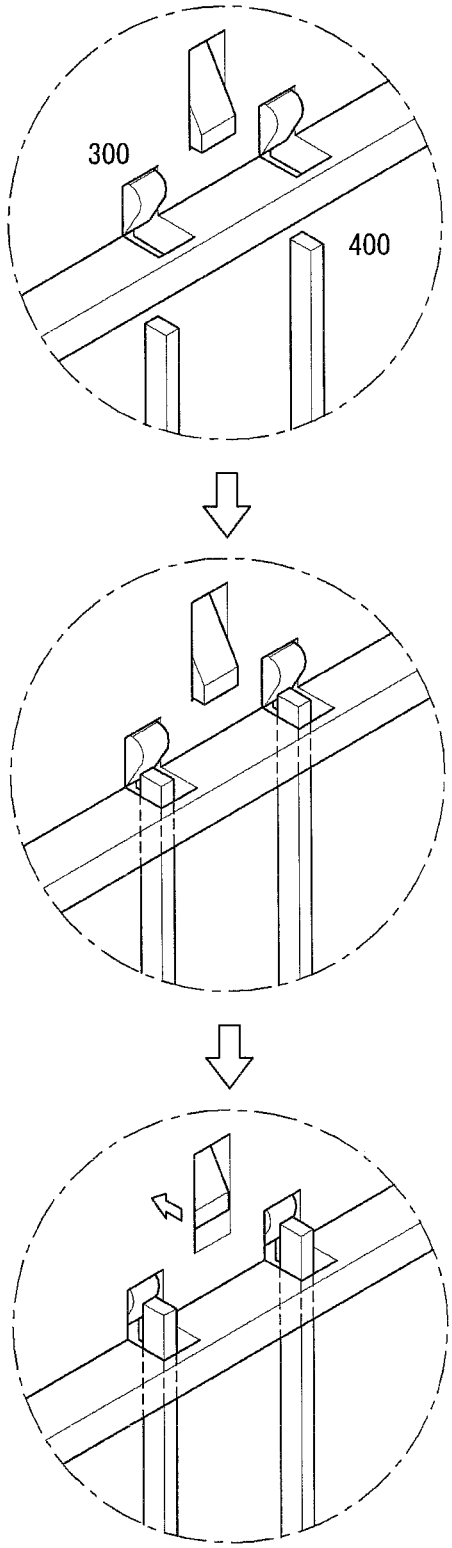
FIG. 7 is a view illustrating processes where a locking unit moves toward the inside of the inner case by protrusions of a jig according to an exemplary embodiment of the present invention.

In the meanwhile, a jig 40 is separately prepared, which has eight protrusions provided in four pairs 400 to 403, each of which is inserted into each of the small holes, as shown in FIG. 6. The protrusions are used to separate the outer case and the inner case from each other.

For instance, the electronic device whose outer case is connected to the inner case is properly seated over the jig with the locking units not viewed from the outside, as shown in FIG. 6. When the electronic device is gradually pressed down in the vertical direction in this state, the protrusion 400 formed on the jig is inserted into the fastener 300 formed on the outer case and pushes the locking unit (not shown in FIG. 6) toward the inside of the inner case. Accordingly, the outer case and the inner case locked to each other by the locking unit may be naturally separated.

As a consequence, the general user may not arbitrarily disconnect the outer case and the inner case from each other without the jig, so that catastrophic failures may be effectively prevented from occurring due to user's arbitrary.

The foregoing embodiments and advantages are merely exemplary and are not to be construed as limiting the present invention. The present teaching can be readily applied to other types of apparatuses. The description of the foregoing embodiments is intended to be illustrative, and not to limit the scope of the claims. Many alternatives, modifications, and variations will be apparent to those skilled in the art.

What is claimed is:

1. A case locking device for securing an inner case of a housing to an outer case of the housing, the case locking device comprising:

a lock that secures the inner case to the outer case with a pressing force, the lock comprising a plurality of laterally spaced-apart protrusions protruding in a same direction through a plurality of laterally-spaced apertures provided in a front cover of the lock, wherein each of the plurality of protrusions has an inclined surface and each of the plurality of protrusions shares a contiguous base portion, and an elastic material that pushes the plurality of protrusions toward a wall of the outer case, wherein the inclined surface of at least one protrusion of the plurality of protrusions is at a different angle of inclination than an angle of inclination of the other protrusions.

2. The case locking device of claim 1, wherein an insertion hole is provided in a side wall of the inner case configured to receive the lock therein, and a fastener is provided in a side surface of the outer case to receive at least one of the plurality of protrusions of the lock inserted through the insertion hole.

3. The case locking device of claim 1, wherein the plurality of the protrusions moves toward an inside of the inner case by a pressing force exerted by the outer case onto the inclined surface of the at least one protrusion, which locks the outer case to the inner case by a resilient force of the elastic material.

4. The case locking device of claim 1, wherein the plurality of the protrusions moves toward an inside of the inner case by a pressing force exerted by at least one protrusion of a jig applied to the inclined surface of the at least one protrusion having the differently angled inclined surface to separate the outer case and the inner case from each other.

5. The case locking device of claim 4, wherein the protrusion of the jig is provided near a location corresponding to a connection location of the lock in order to be inserted into a fastener exposed between the outer case and the inner case.

6. The case locking device of claim 1, wherein the lock is provided inside the housing and is not visible from outside the housing.

7. The case locking device of claim 1, wherein the lock further comprises the front cover, a hook including the base portion and having the plurality of protrusions, and the elastic material, which is located between the hook and a rear cover.

8. The case locking device of claim 2, wherein the insertion hole comprises a through hole having a narrow portion and a wider portion that are integrally formed to each other.

9. The case locking device of claim 2, wherein the fastener comprises at least one first hole that penetrates a side wall of the outer case and one or more second holes that penetrate the side wall and a bottom wall of the outer case.

10. The case locking device of claim 9, wherein the at least one protrusion is inserted into the at least one first hole, and the remaining protrusion or protrusions are inserted into the one or more second holes.

11. The case locking device of claim 10, wherein the at least one protrusion has a step which is hung on the at least one first hole.

12. The case locking device of claim 11, wherein the at least one protrusion has a step comprising a surface having a normal vector that extends in the same direction as a vertical component of the inclined surface of the at least one protrusion.

13. The case locking device of claim 10, wherein one or more protrusions of a jig is inserted into the one or more second holes from the bottom wall of the outer case to separate the outer case and the inner case from each other.

14. The case locking device of claim 13, further comprising a plurality of the locks and a plurality of the fasteners provided at spaced locations around the outer case, wherein the one or more second holes are formed at spaced locations corresponding to the spaced locations of the plurality of the fasteners.

15. A case locking device for securing an inner case of a housing to an outer case of the housing, the case locking device comprising:

a lock comprising a hook having a first protrusion and at least one second protrusion, which are laterally spaced apart and share a contiguous base portion, the first protrusion and the at least one second protrusion protruding in a same direction through a plurality of corresponding laterally-spaced apertures provided in a front cover of the lock, the hook having an extended position and a retracted position, the hook being biased by a spring into the extended position, the first protrusion having an inclined surface on one side of the first protrusion, the at least one second protrusion having an inclined surface on one side of the at least one second protrusion, the one side of the first protrusion facing in a direction opposite to the one side of the at least one second protrusion, wherein the inclined surface of the first protrusion engages an edge of the outer case that forces the hook into a retracted position until the first protrusion is aligned with a first fastener opening formed in the outer case whereupon the spring forces the hook into the extended position and the first protrusion enters the first fastener opening and the at least one second protrusion enters a corresponding second fastener opening formed in the outer case, securing the outer case to the inner case.

16. The case locking device of claim 15, wherein the hook is retractable into the retracted position in which the first protrusion and the at least one second protrusion are not engaged with the first fastener opening and second fastener opening, respectively, when a jig contacts the inclined surface of the at least one second protrusion through the second fastener opening, applying a force to the hook and permitting the outer case to be separated from the inner case.

17. The case locking device of claim 15, wherein the at least one second protrusion comprises a plurality of second protrusions each having an inclined surface.

18. The case locking device of claim 17, wherein the first protrusion further comprises a non-inclined side opposite to the one side of the first protrusion that engages with a complementary edge of the first fastener opening to prevent the outer casing from being removed from the inner case.

19. The case locking device of claim 18, wherein the case locking device is configured to be mountable in a mounting hole formed in the inner case and further comprises a locking device housing having a rear cover in which the hook is slidably mountable, the spring being interposed between the hook and the rear cover, and the front cover, which is configured to contain the hook and spring within the rear cover.

20. A tamper resistant housing comprising the case locking device of claim 19, wherein the outer casing further comprises an outwardly turned flange and wherein a plurality of the second fastener openings are partially formed in the flange.

* * * * *